US007691045B2

(12) United States Patent
Basily et al.

(10) Patent No.: US 7,691,045 B2
(45) Date of Patent: Apr. 6, 2010

(54) TECHNOLOGY FOR CONTINUOUS FOLDING OF SHEET MATERIALS

(75) Inventors: Basily B. Basily, Piscataway, NJ (US); Elsayed A. Elsayed, East Brunswick, NJ (US); Daniel Kling, Ringoes, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 159 days.

(21) Appl. No.: 11/265,571

(22) Filed: Nov. 2, 2005

(65) Prior Publication Data

US 2006/0148632 A1 Jul. 6, 2006

Related U.S. Application Data

(63) Continuation of application No. 10/755,334, filed on Jan. 13, 2004, now Pat. No. 7,115,089.

(60) Provisional application No. 60/448,896, filed on Feb. 24, 2003, provisional application No. 60/448,884, filed on Feb. 24, 2003.

(51) Int. Cl.
*B31F 1/10* (2006.01)

(52) U.S. Cl. ..... 493/435; 493/442

(58) Field of Classification Search ..... 493/463, 493/356–360, 424, 432, 435, 442, 380, 381; 72/179–182
See application file for complete search history.

(56) References Cited

U.S. PATENT DOCUMENTS

| | | | | |
|---|---|---|---|---|
| 1,485,917 | A | 3/1924 | Harter | 72/176 |
| 1,766,743 | A | 6/1930 | Freeze | 72/180 |
| RE18,760 | E | 3/1933 | Yoder | 72/180 |
| 2,901,951 | A | 9/1959 | Hochfeld | 493/442 |
| 3,251,211 | A | 5/1966 | Harris | 72/182 |
| 3,799,039 | A * | 3/1974 | Johnson | 493/357 |
| 3,988,917 | A | 11/1976 | Mykolenko | 72/187 |
| 4,012,932 | A | 3/1977 | Gewiss | 72/187 |
| 4,026,198 | A * | 5/1977 | Ottaviano | 493/357 |
| 4,411,146 | A | 10/1983 | Sulasaari et al. | 72/180 |
| 5,028,474 | A | 7/1991 | Czaplicki | 428/178 |
| 5,107,695 | A | 4/1992 | Vandenbroucke | 72/129 |
| 5,185,052 | A | 2/1993 | Chappell et al. | 156/462 |
| 5,664,451 | A | 9/1997 | Schultz | 72/181 |
| 5,947,885 | A | 9/1999 | Paterson | 493/451 |
| 5,983,692 | A | 11/1999 | Brück | 72/187 |
| 6,209,375 | B1 | 4/2001 | Kurose | 72/181 |
| 6,289,707 | B1 | 9/2001 | Saarenko | 72/177 |
| 6,935,997 | B2 * | 8/2005 | Kling | 493/356 |
| 2002/0094926 | A1 * | 7/2002 | Kling | 493/356 |

FOREIGN PATENT DOCUMENTS

| | | |
|---|---|---|
| EP | 0 318 497 B1 | 11/1991 |
| EP | 0 261 140 B1 | 7/1992 |

* cited by examiner

*Primary Examiner*—Louis K Huynh
(74) *Attorney, Agent, or Firm*—Kenneth Watov; Watov & Kipnes, P.C.

(57) ABSTRACT

A machine and method for the continuous folding of sheet material into difference three-dimensional patterns is featured. The innovative machine and method folds sheet material by force converging the sheet to a final stage that imparts a final fold or pattern. Unique programming allows for the change of convergence sequencing and change of materials.

5 Claims, 4 Drawing Sheets

TECHNOLOGY FOR CONTINUOUS FOLDING OF SHEET MATERIALS

RELATED APPLICATIONS

This application claims priority from U.S. Provisional Application Nos. 60/448,896 and 6/448,884 each filed on Feb. 24, 2003. This Application is a Continuation from Non-Provisional application Ser. No. 10/755,334 filed on Jan. 13, 2004, now U.S. Pat. No. 7,115,089 the teachings of which are incorporated herein to the extent they do not conflict herewith.

FIELD OF THE INVENTION

The present invention relates to the folding of sheet materials and, more particularly, to the continuous folding of different types of sheet materials into a multiplicity of predetermined, three-dimensional structural patterns.

BACKGROUND OF THE INVENTION

Folded materials are useful in packaging technology, sandwich structures, floor boards, car bumpers and other applications where requirements pertaining to shock, vibration, energy absorption, and/or a high strength-to-weight ratio including volume reduction must be met.

Continuous folding machines should have versatility, flexibility, and high production rates. Additionally, a machine that can additionally accomplish folding in an inexpensive manner is most rare.

The present inventive machine not only accomplishes the folding of materials in accordance with the aforementioned objectives, but is unique in its ability to fold materials over a wide range of sizes. The machine is also unusual, in that it can handle a wider range of materials.

A machine with the ability to fold different types of sheet materials, as opposed to mere metal, provides a cost saving, because users need invest in only one machine.

A single machine that can fold many different patterns and which can accommodate different materials demonstrates the flexibility of the current invention.

The inventive machine can generate patterns with extensive geometric variations within the same family of patterns. The generated patterns can then be used in many applications such as cores for sandwiched structures, pallets, bridge decks, floor decks, and packaging applications.

The invention accomplishes all of the above objectives by having both a unique structure and unique programming. The programming allows for the change of the folding sequence, so that different patterns can be produced. The programming also allows for change of materials. The programming is the subject of a co-pending U.S. application Ser. No. 09/952,057; filed Sep. 14, 2001, now published application Pub. No. 2002/0094926A1, the teachings of which are intended to be incorporated herein by reference.

In a general overview, the inventive machine causes the material to "funnel" towards an end section, which imparts the final folds or pattern. The funnel process can be thought of as a method that forces, converges, or continuously positions the material towards the final section of the machine, where the material is then finally folded in the desired pattern.

DISCUSSION OF RELATED ART

U.S. Pat. No. 3,988,917, issued to Petro Mykolenko on Nov. 2, 1976 for Apparatus and Method for Making A Chevron Matrix Strip; U.S. Pat. No. 4,012,932, issued to Lucien Gewiss on Mar. 22, 1977 for Machine for Manufacturing Herringbone-Pleated Structures; U.S. Pat. No. 5,028,474, issued to Ronald Czaplicki on Jul. 2, 1991 for Cellular Core Structure Providing Gridlike Bearing Surfaces on Opposing Parallel Planes of the Formed Core; U.S. Pat. No. 5,947,885, issued to James Paterson on Sep. 7, 1999 for Method and Apparatus for Folding Sheet Materials with Tessellated Patterns; and U.S. Pat. No. 5,983,692, issued to Rolf Brück on Nov. 16, 1999 for Process and Apparatus for Producing a Metal Sheet with a Corrugation Configuration and a Microstructure Disposed Transversely with Respect Thereto; and European Patent Publication Nos. 0 318 497 B1, issued to Nils Höglund on Nov. 27, 1991 for Machine for Corrugating Sheet Metal or the Like; and 0 261 140 B1, issued to Nilsen et al. on Jul. 1, 1992 for Machine for Adjustable Longitudinal Corrugating of Sheet Materials, all relate to the art of forming sheet material. However, none of these patents or publications discloses a machine that performs a folding operation using tessellations according to the mathematical series 1, 3, 5, 7, . . . on each roller in a series of rollers or grooves on parallel flat dies or surfaces.

SUMMARY OF THE INVENTION

In accordance with the present invention, a machine and method for the continuous folding of sheet material into different three-dimensional patterns is disclosed.

In a general overview, the inventive machine causes the material to funnel towards an end section, which imparts the final folds or pattern. The funnel process can be thought of as a method of force convergence, or continuous-positioning of the material towards the final stage of the machine. The material is then finally folded in the desired pattern at the final stage.

The invention accomplishes all these functions by having both a unique structure and unique programming. The programming allows for the change of the folding sequence, so that different patterns can be produced. The programming also allows for a change of material and a change of material size. The programming is the subject of a co-pending U.S. application Ser. No. 09/952,057; filed Sep. 14, 2001, now published application Pub. No. 2002/0094926A1, the teachings of which are intended to be incorporated herein by way of reference.

The innovative machine folds sheet material, including paper, biodegradable material, composites and plastics, enables a flat sheet of material to be fed through a series of rollers or dies (the number of which is a function of final product width) that pre-fold the material until it reaches the last set of rollers or dies. The final fold pattern is implemented by having the pattern geometry negatively engraved on these rollers. The direction of the engraved folding pattern on the last set of rollers can be made longitudinal or perpendicular to the roller axis (or at any desirable angle in between), resulting in a longitudinal or cross-folded sheet. Further, the last set of rollers can be rubber on metal (one roller from rubber and the other from metal to create sharp increases in the folded pattern.

The material is fed between the first set of rollers or dies, which makes a central single fold in the middle of the material. The material then advances to a second set of rollers or dies, that makes two extra outer folds, one on each side of the first fold. The material then advances to a third set of rollers or dies, making two additional outer folds. This process continues at the sequenced sets of rollers or dies until the desired number of folds in the rolling direction is reached.

At the last set of rollers or dies, the material is rolled between two rollers or dies having cross fold patterns engraved/machined on their surfaces to produce the final pattern. No additional folds are made at the last set of rollers or dies. The design, manufacture, and integration of the last set of rollers or dies is flexible enough that other patterns can easily be produced in a short period of time and with minimum machine setting of both pre- and final folding stages. The above procedures are applicable to any other method for folding based on the principle of series 1, 3, 5, 7, . . . . This includes flat dies or frames with grooves that follow this sequence.

The folded sheet, upon leaving the inventive machine, can be compressed further to any desired compaction ratio and/or laminated to produce structures and packaging material with specific characteristics. The design flexibility of the machine allows folding patterns of different materials and different thicknesses and/or with different mechanical properties.

Specifically, the invention performs folding in the mathematical series 1, 3, 5, 7, . . . , where the numerals are related to the number of tessellations on the surface of each set of rollers or dies at each stage of the initial folding process. This specific sequencing, creating two new longitudinal tessellations on each successive set of rollers according to the mathematical series 1, 3, 5, 7, . . . totally eliminates the typical material slitting phenomenon, which occurs if all tessellation is performed in one set of rollers or dies, causing material to be cogged in, and stretch to conform to, roll or die profile. This innovative technique eliminates this slitting phenomena by subjecting the sheet material to only two predetermined transverse friction forces: one on each edge of the sheet. Material on the edges have access to flow in from the sides to form the next two extra tessellations without undue restriction.

The innovative sequential tessellation technique enables sheet materials to be effectively folded with minimum power requirements, and without sheet slitting and/or stretching.

This technology introduces new and highly economical methods of producing lightweight cores, structures, and packages that outperform most of the existing comparative structures and their methods of production. The material that is formed has many applications ranging from the design of diesel filters, to aviator crash helmets, to high-speed lighters, to airdrop cushioning systems, to biodegradable packaging materials and to lightweight floor decks, among others. The technology can produce structures of versatile shapes, single and multiple layers, and different patterns created from different materials, geometries and dimensions.

The inventive machine has produced packages that have outperformed honeycomb packages, the current industry and government standard. The produced cushioning packaging pads are capable of absorbing significantly higher energy per unit volume when compared with honeycomb packaging structures.

All types of 3-D geometrical patterns can be formed from a flat sheet of material without stretching, and then selecting such a pattern to be folded. Specifically, to preserve the folding intrinsic geometry, each vertex in a faceted surface must have all the angles meet at the point from adjacent faces to total 360 degrees. This 360-degree total of angles is required for the vertex to unfold and lay flat in the plane, thereby eliminating stretching.

A mathematical theory of the folding geometry of this invention was been developed by Daniel Kling, one of the current inventors, and can be studied in greater detail in United States Patent Publication No. US2002/0094926. This theory facilitates the pattern selection process for use with the inventive machine. A pattern can be chosen via this mathematical theory based on different criteria, such as geometry, strength, or density, based on the desired parameters of the final product.

Other existing technologies for folding sheet materials are not at all similar to the inventive technology. For example, the above-referenced PATERSON patent consists of flat and rigid tessellations that are identical to those of the pattern to be produced in the final folded shape. This technology and other types of technologies result in non-uniform change in both sheet thickness and material properties, due to the nature of the forming operation. This is opposed to the current invention's folding operation that does not stretch or adversely change any of the existing material physical or mechanical properties.

An advantage of the present invention is its ability to fold sheet material into a continuous intricate faceted structure.

Another advantage of the present invention is that it is a versatile, flexible, and inexpensive machine that performs various folding operations.

Another advantage of the present invention is its ability to fold sheet material while preserving its intrinsic geometry without stretching it.

Another advantage of the present invention is its ability to fold sheet material with minimum energy and load requirement, due to the nature of the folding mechanism being of very localized deformed zones of plastic hinges formed on tessellation edges.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, a machine for continuous folding of sheet materials is featured. The machine comprises a plurality of rollers or dies, each with a different amount of raised portions (related to the number of tessellations) for creating folds in the material traveling through the machine.

Figure 1:
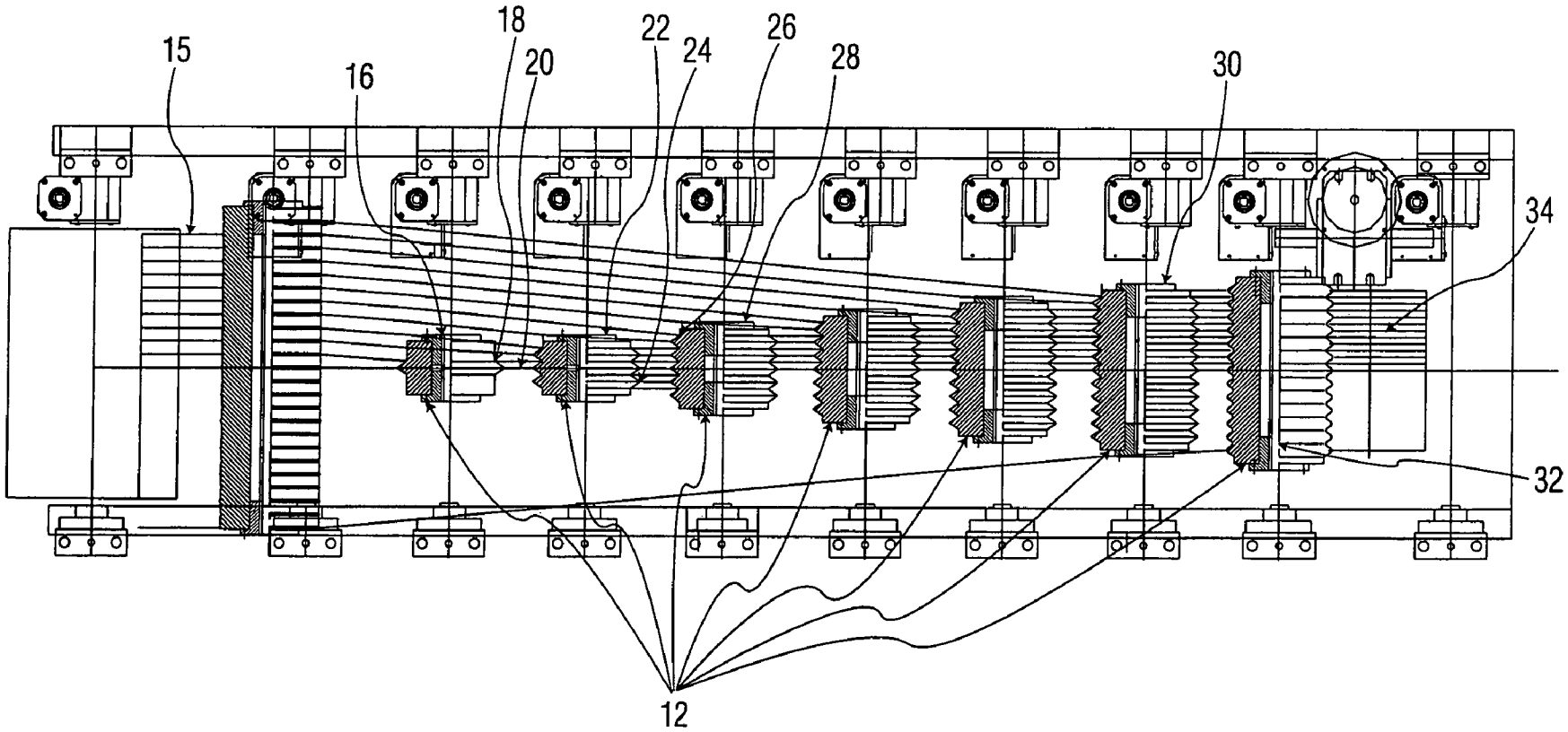
FIG. 1 illustrates a top view of the machine of this invention for continuous folding of sheet materials.
Figure 2:
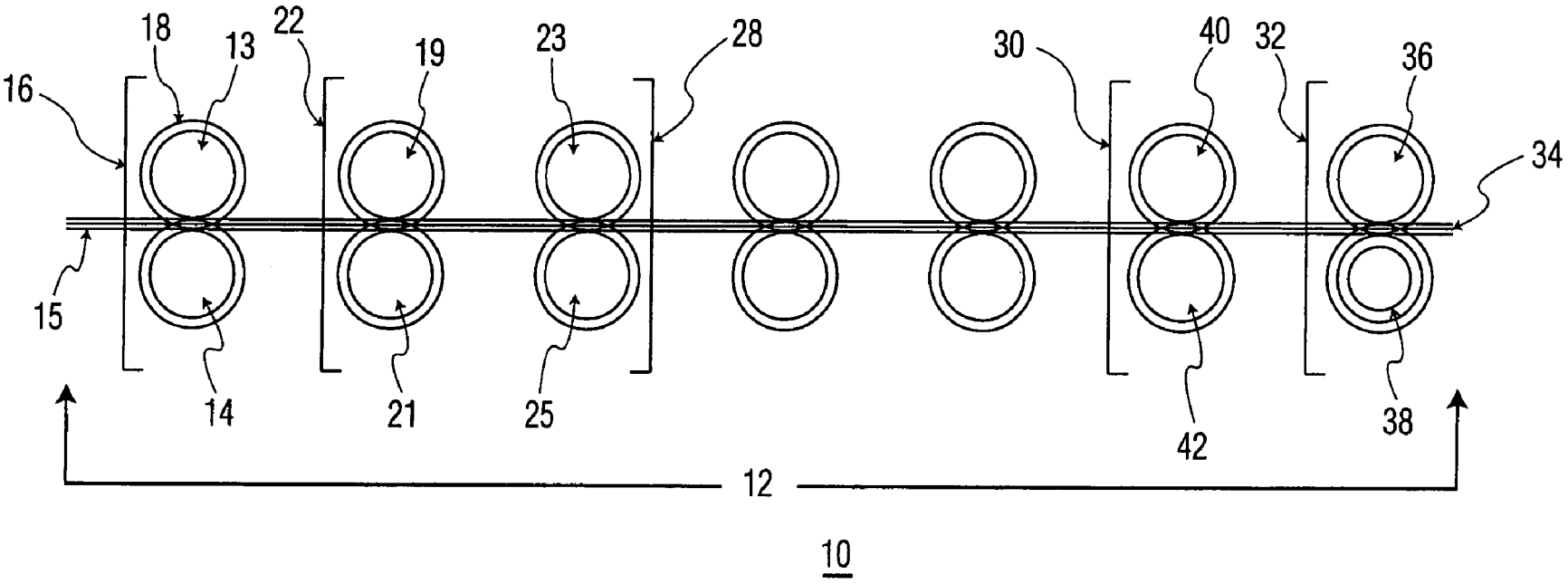
FIG. 2 illustrates a side view of the machine for continuous folding of sheet materials.
Figure 3:
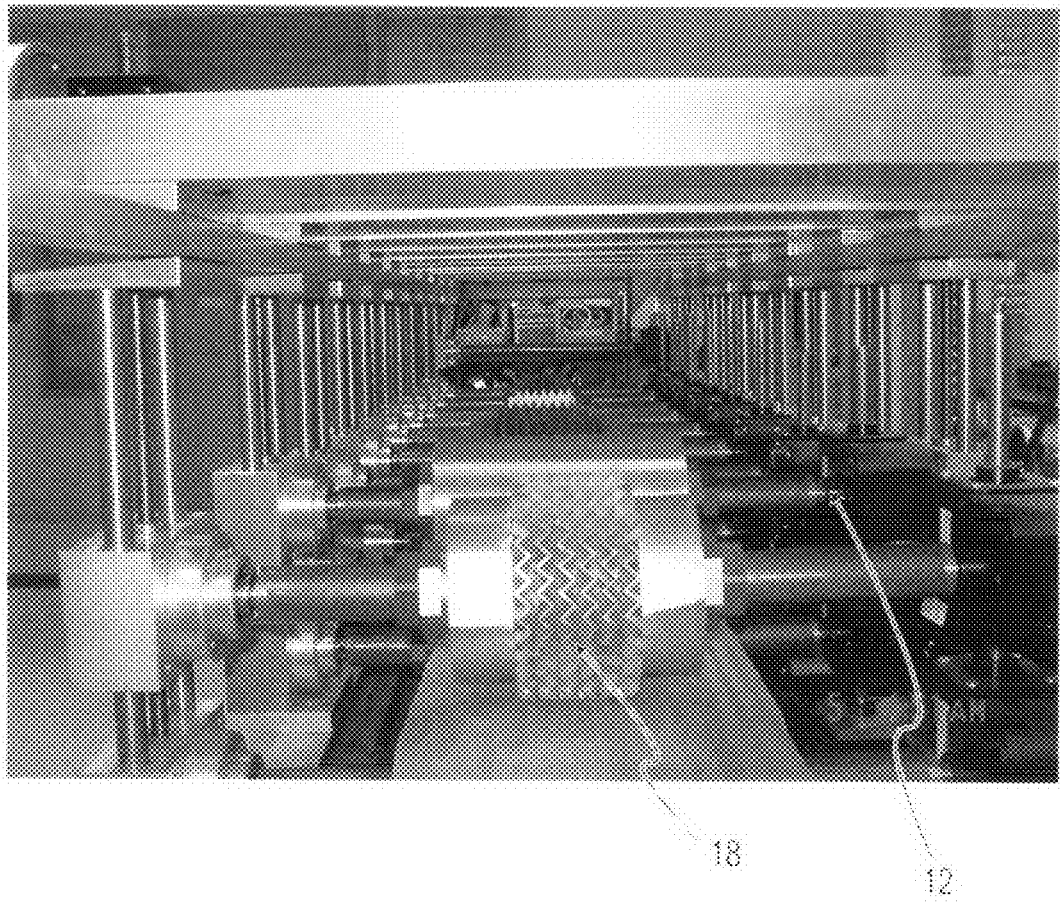
FIG. 3 illustrates a front view of the machine for continuous folding of sheet materials.

Now referring to FIG. 1, the machine for continuous folding of this invention, generally referred to as number 10, is shown. The machine for continuous folding 10 comprises a plurality of sets of rollers or dies 12. A set of rollers 12 comprises upper rollers and lower rollers, shown in FIG. 2. Each set of rollers, or dies 12 has a number of tessellations 18 for folding sheet material 15, also shown in FIG. 3, where each tessellation is a series of raised shapes (sometimes "V" shaped) that span the circumference of the roller.

The sheet material 15 is fed through the first proximal set of rollers or dies 16. Each roller or die 13, 14 of the first proximal set of rollers or dies 16 has one tessellation 18. This tessellation 18 makes a single fold 20 in the sheet material 15.

Each roller or die 19, 21 of the second set of rollers or dies 22 has three tessellations for making an additional two folds in the sheet material 15. The single fold 20 produced by the first proximal set of rollers or dies 16 proceeds through the center tessellation of the second set of rollers or dies 22 where it maintains its shape. Two new folds 24, 26 are created by the outside tessellations of the second set of rollers or dies 22.

Figure 4:
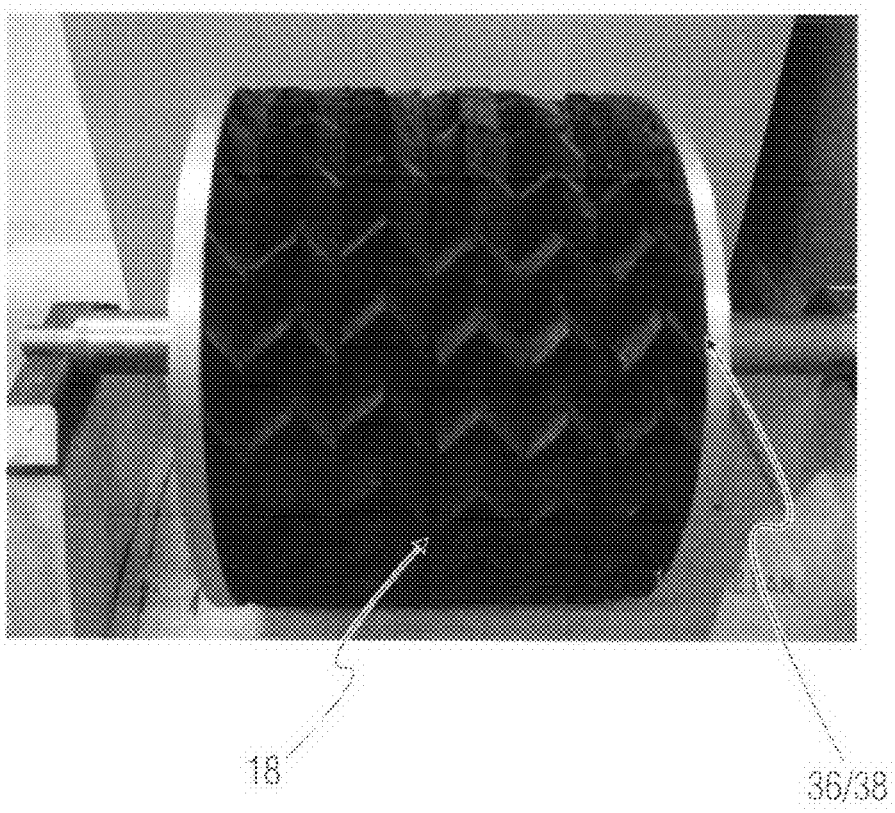
FIG. 4 illustrates the last set of rollers of the machine for continuous folding of sheet materials.

Each roller or die 23, 25 of the third set of rollers or dies 28 has five tessellations, two more tessellations 18 than each roller or die 19, 21 in the previous second set of rollers or dies 22. This pattern of two additional tessellations 18 per roller or die continues from the first set of rollers or dies 16 to the penultimate set of rollers or dies, shown in this embodiment at numeral 30. Each roller or die 36, 38 of the final set of rollers or dies 32 (also shown as a close up in FIG. 4) has the same number of tessellations 18 as each roller or die 40, 42 of the penultimate set of rollers or dies 30. The final fold pattern 34 is implemented by having the pattern geometry negatively engraved on the last set of rollers or dies 32. Further, the last set of rollers or dies 32 can be made of rubber to create sharp creases in the sheet material 15.

Seven sets of rollers or dies are depicted in FIG. 1, but the inventive machine for continuous folding 10 can have any number of sets of rollers or dies depending on the desired width of the final folded structure. The number of tessellations 18 on each roller or die is determined from the mathematical series 1, 3, 5, 7, . . . , where each roller or die 13, 14 in the first proximal set of rollers or dies 16 has one tessellation 18, and each roller or die 19, 21 in the second set of rollers or dies 22 has three tessellations 18, etc.

Should the user decide to use the special rubber rollers or dies, however, each of either roller or die 36, 38 in the last set of rollers or dies 32 has the same amount of tessellations 18 as each roller or die 40, 42 in the penultimate set of rollers or dies 30. The final material 34 is in the desired form once it leaves the last set of rollers or dies 32. To fold a different pattern on the sheet material 15, the tessellations 18 on all of the rollers or dies can be easily changed.

The design of the machine for continuous folding 10 allows any length of material to be folded. The sheet material 15 starts out at its widest width at the first set of rollers or dies 16 and becomes narrower at each successive set of rollers or dies, as the number of tessellations 18 increases (FIG. 1). This design allows for any length of material to be folded without incurring damage (e.g., stretching) to the sheet material 15.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A method of folding sheet material in patterns, comprising the steps of:

a) receiving sheet material to be folded;

b) sequentially folding continuously moving said sheet material to produce a plurality of juxtaposed longitudinal folds via successive fold operations according to a sequence of folds comprising the non-repetitive mathematical series 1, 3, 5, 7, . . . , with each new fold sequence of the series adding two additional folds;

c) folding said sequentially folded sheet material into a final pattern that includes folds at an angle to said longitudinal folds for producing a cross-folded sheet of said sheet material; and d) programming the folding of the sheet material via the sequence of the fold operations to accommodate folding of a particular type of sheet material, and/or size of sheet material.

2. A folding machine for folding sheet materials in different patterns, comprising:

a first stage for receiving sheet material to be folded, said first stage including:

folding means for sequentially folding continuously moving sheet material only into a plurality of juxtaposed longitudinal folds via successive fold operations in accordance with a sequence of folds based upon a non-repetitive mathematical series 1, 3, 5, 7, . . . , with each new fold sequence of the series adding two additional folds; and a second stage having means for folding sheet material received from said first stage into a final pattern that includes folds at an angle to said longitudinal folds for producing a cross-folded sheet of said sheet material.

3. The folding machine in accordance with claim 2, wherein said first stage further comprises programming means for controlling said sequence of successive folding operations to produce different patterns.

4. A folding machine for folding different sheet materials, comprising:

a first stage for receiving a material to be folded, said first stage including folding means for sequentially folding continuously moving said sheet material to produce a number of juxtaposed longitudinal folds via successive fold operations according to a sequence of folds comprising a non-repetitive mathematical series 1, 3, 5, 7, . . . , with each new fold sequence of the series adding two additional folds;

a second stage having means for folding said material into a final pattern that includes folds at an angle to said longitudinal folds for producing a cross-folded sheet of said sheet material; and programming means associated with said first stage for controlling said first stage to accept and process different materials and/or materials of different sizes.

5. A folding machine for folding sheet materials in different patterns, comprising:

a funneling first stage for receiving sheet material to be folded, said funneling stage including folding means for sequentially folding continuously moving said sheet material to produce a number of juxtaposed longitudinal folds via successive fold operations according to a sequence of folds comprising a non-repetitive mathematical series 1, 3, 5, 7, . . . , with each new fold sequence of the series adding two additional folds;

programming means for controlling said sequence of folding operations to produce a desired pattern; and a second stage for receiving said sheet material from said first stage, said second stage retaining the number of juxtaposed longitudinal folds produced in said first stage, said second stage including means for folding said sheet material into a final pattern that includes folds at an angle to said longitudinal folds for producing a cross-folded sheet of said sheet material.

* * * * *